United States Patent [19]

Delzenne et al.

[11] 4,263,395

[45] Apr. 21, 1981

[54] HIGH INTENSITY PHOTON-IMAGE RECORDING

[75] Inventors: Gerard A. Delzenne, 's-Gravenwezel; Hendrik E. Kokelenberg, Merksem, both of Belgium

[73] Assignee: AGFA-GEVAERT N.V., Mortsel, Belgium

[21] Appl. No.: 31,151

[22] Filed: Apr. 18, 1979

Related U.S. Application Data

[63] Continuation of Ser. No. 851,627, Nov. 15, 1977.

[30] Foreign Application Priority Data

Nov. 18, 1976 [GB] United Kingdom ..... 48134/76

[51] Int. Cl.[3] ..... G03C 1/52; G03C 5/24; G03C 5/04

[52] U.S. Cl. ..... 430/332; 430/343; 430/344; 430/345; 430/945

[58] Field of Search ..... 96/27 E, 48 QP, 90 R, 96/90 PC; 430/332, 343, 344, 345, 945, 340, 444

[56] References Cited

U.S. PATENT DOCUMENTS

| | | | |
|---|---|---|---|
| 3,502,476 | 3/1970 | Itano et al. | 96/90 R |
| 3,667,954 | 6/1972 | Itano et al. | 96/90 R |
| 3,810,762 | 5/1974 | Laridon et al. | 96/48 QP |
| 3,817,752 | 6/1974 | Laridon et al. | 96/48 QP |
| 4,006,021 | 2/1977 | Yamashita et al. | 96/48 QP |

*Primary Examiner*—Won H. Louie, Jr

*Attorney, Agent, or Firm*—William J. Daniel

[57] ABSTRACT

A recording method for directly forming a visible image, which method comprises exposing a recording material information-wise to ultra-violet radiation having a wave-length in the range of 200 nm to 400 nm, with a radiation intensity of at least $5\times10^{11}$ erg/sq.cm.s so that the recording material receives a radiation energy dose of at least $1\times10^{7}$ erg/sq.cm, the said recording material containing in a layer in admixture with an organic binder medium:

(A) at least one dye precursor compound, which is a spiropyran compound or a compound corresponding to one of the general formulae (I)

(II)

wherein:

R represents hydrogen, a lower alkyl ($C_1$–$C_3$) group, a lower alkyl group, a phenyl group or phenyloxy, $R^1$ represents an organic group, $Z^1$ represents the necessary atoms to close a homocyclic ring or ring system, $Z^2$ represents the necessary atoms to close a homocyclic ring or ring system, $R^2$ represents a lower alkyl ($C_1$–$C_5$) group, and n is 1 or 2, (B) at least one organic UV-sensitive compound which is capable of splitting off halogen upon exposure to ultra-violet radiation in the range of 200 nm to 400 nm, and which is selected so that when present in a test recording material as defined in the specification and when said material is subjected to test (X) as defined in the specification a density increase at the wavelength of maximum absorption in the visible light range of not more than 0.15 is obtained, the density measurement being a totally diffuse density measurement and when said material is subjected to test (Y) as defined in the specification a white light specular density of at least 0.35 above inherent fog is obtained.

11 Claims, 2 Drawing Figures

HIGH INTENSITY PHOTON-IMAGE RECORDING

Figure 1:
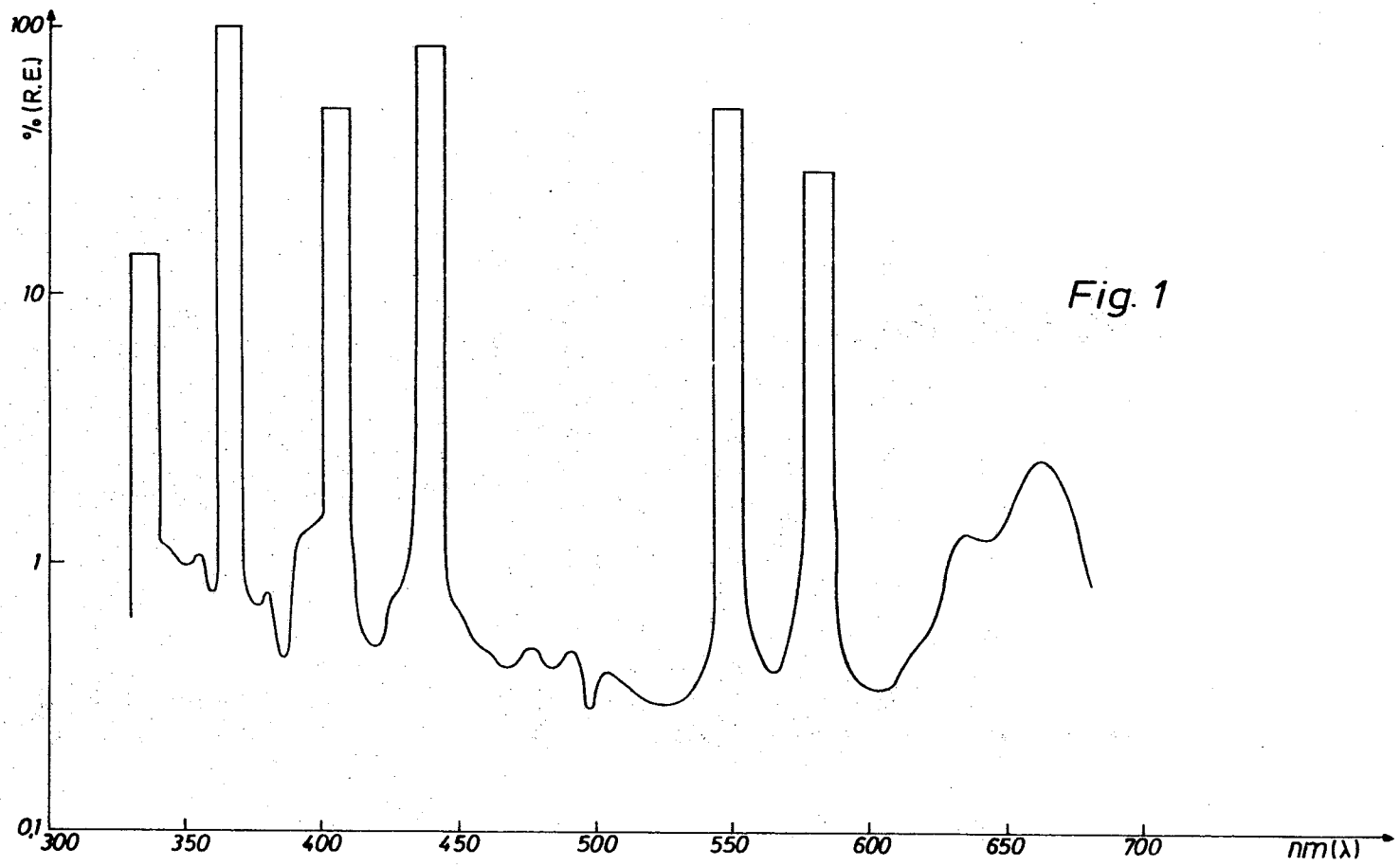

This is a continuation, of Ser. No. 851,627, filed Nov. 15, 1977.

This invention relates to high intensity photon-image recording and to materials particularly suited for this purpose.

In the United Kingdom Pat. No. 1,209,710 a dry-working, high-speed, free-radical, photosensitive material has been described suitable for normal picture-taking purposes and which is responsive to lasers such as a krypton ion laser exhibiting a peak output in the spectral region of 400 nm or an argon ion laser exhibiting a peak output in the spectral region of 488 nm.

Said photosensitive material is fixed by heating. The heating serves to remove the photoactivator, which is a relatively volatile organic polyhalogen compound such as iodoform.

The introduction of iodoform in the environment is to be avoided so that fixation has to proceed in a closed cabinet.

To simplify image production, it would be advantageous to avoid using iodoform and to omit said fixing step.

According to the present invention a method for high-intensity photon-image recording such as laser beam recording is provided wherein real time images are produced i.e. visible images are produced directly at the amount of the image-wise irradiation of the recording material.

Further the present invention provides a recording material that needs no image fixation to protect it against background staining by daylight and that has add-on possibilities in time i.e. which after image recording can be used for further image recording.

In accordance with the present invention a recording method for directly forming a visible image is provided, which method comprises exposing a recording material information-wise to ultraviolet radiation having a wave length in the range of 200 nm to 400 nm, with a radiation intensity of at least $5\times10^{11}$ erg/sq.cm.s. and so that the recording material receives a radiation energy dose of at least $1\times10^{7}$ erg/sq.cm, the said recording material containing in a layer in admixture with an organic binder medium:

(A) at least one dye precursor compound which is a spiropyran compound or a compound corresponding to one of the general formulae:

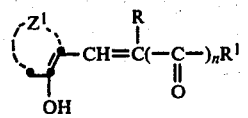

(I)

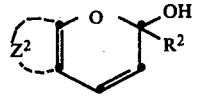

(II)

wherein:

R represents hydrogen, a lower ($C_1$–$C_3$) alkyl group e.g. methyl, a substituted lower alkyl group e.g. benzyl, a phenyl group including a substituted phenyl group, or phenyloxy, $R^1$ represents an organic group, e.g. an aliphatic group including a substituted aliphatic group, e.g. an alkyl group including a substituted alkyl group or an aryl group including a substituted aryl group, or represents together with R the necessary atoms to close a homocyclic ring, e.g. a cyclohexylen-2-one ring, $Z^1$ represents the necessary atoms to close a homocyclic ring or ring system including such a ring or ring system in substituted state e.g. a phenyl group, a naphthyl group or such groups carrying in addition to the hydroxyl group one or more substitutents e.g. a methoxy group or a benzyl group that is further substituted with a hydroxy group, and a—CH=CH—$COR^1$ group, $R^1$ having the significance as defined above.

$Z^2$ represents the necessary atoms to close a homocyclic ring or ring system including a substituted homocyclic ring or ring system, e.g. a benzene or a naphthalene ring including a substituted benzene or naphthalene ring, $R^2$ represents a lower alkyl ($C_1$–$C_5$) group, and n is 1 or 2, and (B) at least one organic UV-sensitive compound capable of splitting off halogen upon exposure to ultra-violet radiation in the range of 200 nm to 400 nm.

Said substance (B) is selected such that when present in a test recording material as defined hereinafter and when subjected to test (X) as defined hereinafter, a density increase at the wavelength of maximum absorption in the visible light range (400–700 nm) of not more than 0.15 is obtained, the density measurement being a totally diffuse density measurement and when subjected to test (Y), a specular white light (400–700 nm) density of at least 0.35 above inherent fog is obtained, such specular density being measured with an Ansco (trade name) Automatic Recording Microdensitometer—Model 4—, whose numerical aperture of the exposure lens is 0.4, the measurement proceeding with the line exposure diaphragm at position 1 of the corresponding microscrew, said line diaphragm being preceded by an exposure slot set on position 6 with the corresponding microscrew of the apparatus.

By specular density is meant, as is known to the skilled art worker, the transmission density measured under conditions where the cone angles of illumination and collection are very small (5°–10°) (cfr. C. E. Kenneth Mees and T. H. James—The Theory of the Photographic Process, The Macmillan Company New York 3rd Ed. (1969) p. 421. At the same page 421 a definition of totally diffuse density is given. In the present totally diffuse density measurement the cone angle of illumination is 7.5° and all of the transmitted light is collected and equally detected.

The test recording material contains β-methyl-naphthospiropyran as representative for a dye precursor compound mentioned under (A) in admixture with a selected compound of group (B).

Said compounds are coated on a glass support from a coating mixture containing compounds (A) and (B) in a 1:2 molar ratio and said coating mixture contains as binder copoly-(N-vinylcarbazole/methyl acrylate/hydroxyethyl acrylate) (60/30/10 by weight) dissolved in 1,1,2-trichloroethane. A 5% by weight solution of said copolymer in 1,1,2-trichloroethane has a viscosity of 55 cp at 20° C. The coating is effected such that on said glass support 0.6 g of compound (B) is present per sq.m and 15 g per sq.m of said copolymer, whereupon the recording material is dried.

DESCRIPTION OF TEST (X)

Test (X) is carried out by exposing the dried test recording material for 8 hours at 20° C. at a distance of 15 cm with a HPL-80 W mercury vapour lamp of N. V. Philips' Gloeilampenfabrieken, Eindhoven, the Netherlands. The emission spectrum of the radiation emitted by the mercury vapour lamp, viz. % relative emission (R.E.) versus wavelength (λ) in nm, in the range of 330 to 680 is represented in the accompanying FIG. 1. The radiation intensity of the lamp at a distance of 15 cm from the centre thereof is about $10^5$ erg/sq.cm.s.

DESCRIPTION OF TEST (Y)

Test (Y) is carried out by exposing the dried test recording material with an Argon ion laser beam containing photons of 351.1 nm and 363.8 wavelength. The exposure proceeds up to a phonton energy dose of $4\times10^7$ erg/sq.cm, the radiation intensity of the focussed beam being $2\times10^{12}$ erg/sq.cm.s.

The radiation intensity also called beam intensity is the radiant power per unit area normal to the direction of propagation and is measured in W/sq.m ($1W=10^7$ erg/s), (ref. Principles of College Physics, 2nd ed., Prentice-Hall, Inc., Englewood Cliffs, New Jersey (1967) p. 469.

Preferred colourless dye precursor compounds for use according to the present invention are spiropyran compounds containing at least one pyran ring having in the ortho- and meta-position to the oxygen atom an adjacent benzo or naphtho ring or other aromatic polycyclic condensed ring systems e.g. an anthraceno or phenanthreno ring system or such ring systems in substituted form. Specific examples are a spirodibenzopyran, a spirodinaphthopyran, a spirobenzonaphthopyran, a 1,3,3-tirmethylindolinobenzospiropyran, a 1,3,3-trimethylindolinonaphthospiropyran or such spiropyrans containing condensed aromatic nuclei of the anthracene or phenanthrene type.

In such spiropyrans the pyran rings, the condensed higher aromatic rings as well as the 1,3,3-trimethylindolino ring may be substituted e.g. by alkyl groups, particularly $C_1$–$C_5$ alkyl groups, substituted alkyl groups e.g. halogen- or phenyl-substituted alkyl groups, alkylene ester groups e.g. a—$CH_2$—$COOC_2H_5$ group, alkylene carboxyl groups e.g. a—$CH_2$—COOH group, alkylene carbonamide groups or such groups, in which the carbonamide group is substituted e.g. a

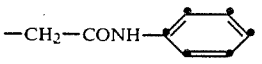

an acyl group, e.g. acetyl, halogen, nitro, hydroxy, alkoxy, aryloxy or a substituent linking the carbon atoms in 3,3'-position in the spiropyran system together e.g. a $(CH_2)_n$-chain wherein n is 2 or 3.

Particularly suitable spiropyrans are represented by the following structural formulae:

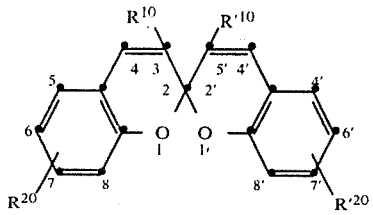

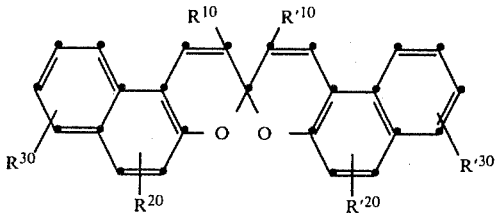

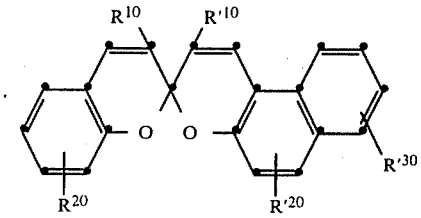

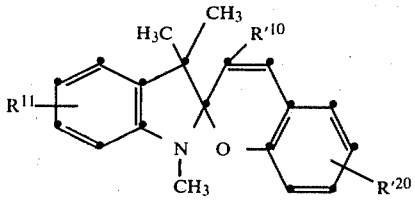

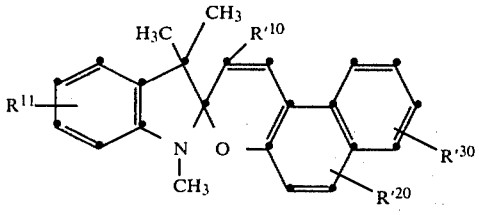

wherein:

each of $R^{10}$, $R^{11}$, $R'^{10}$, $R^{20}$, $R'^{20}$, $R^{30}$, and $R'^{30}$, which may be the same or different, represents hydrogen, an alkyl e.g. a $C_1$–$C_{20}$ alkyl group or a substituted alkyl group, particularly a methyl, ethyl, propyl, amyl or hexadecyl group, halogenated alkyl group, an alkylene ester group e.g. a—$CH_2$—$COOC_2H_5$ group, an alkylene carboxyl group e.g. a—$CH_2$—COOH group, an alkylene carbonamide group or such a group in which the carbonamide group is substituted e.g. a

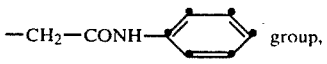

an acyl e.g. acetyl group, halogen, nitro, hydroxy, an alkoxy or aryloxy group, a phenyl group, a substituted phenyl group, piperidyl, or $R^{10}$ and $R'^{10}$ together represent a—$(CH_2)_n$—chain wherein n=2 or 3 to link the carbon atoms in the 3 and 3' positions together.

Such spiropyran compounds and their preparation are described in the published German patent applications Nos. 1,274,655, 1,269,665, 1,286,110, 1,286,111, and 1,286,112, and by W. Dilthey, Berres, Hölterkoff, Wübken, J. Prakt. Chem. [2]114, 187 (1926), by C. F. Koelsch and W. R. Workman in J. Am. Chem. Soc. 74, 6288 (1952) and by I. M. Heilbron and G. F. Howard in J. Chem. Soc. (1934), 1571.

Preferred spiropyran compounds are spirodinaphthopyrans and spirobenzonaphthopyrans including such compounds wherein the naphtho- and/or benzo ring(s) is (are) substituted.

A list or particularly useful spiropyran compounds is given in Table 1.

TABLE 1

| Spiropyran compound | Melting point (°C.) |
|---|---|
| 1. 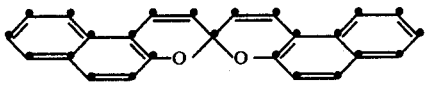 | 257 |
| 2. 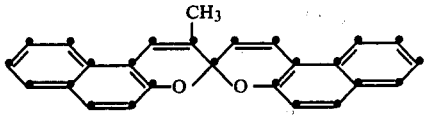 | 204 |
| 3. 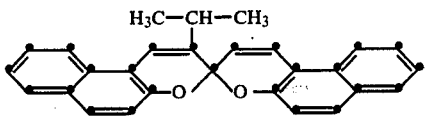 | 208 |
| 4. 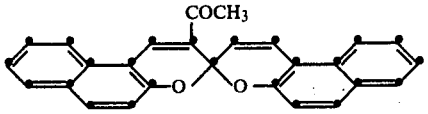 | 260 |
| 5. 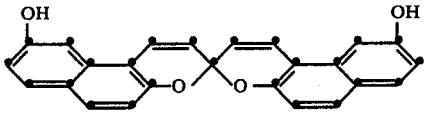 | >260 |
| 6. 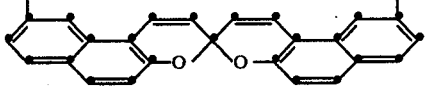 | >260 |
| 7. 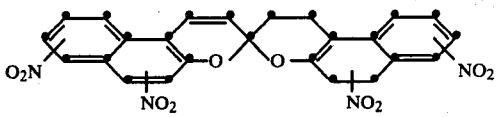 | >260 |
| 8. 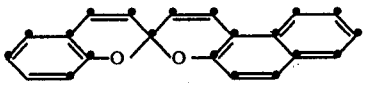 | 168 |
| 9. 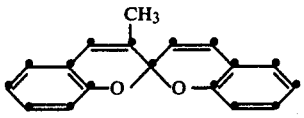 | 110 |
| 10. 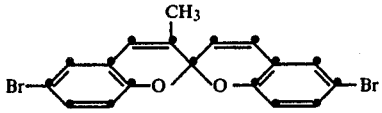 | 163 |
| 11. 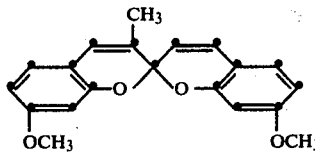 | 110 |

The dye precursor compounds according to general formula (I) are prepared e.g. according:

Heilbron and Whitworth. J. Chem. Soc. 123, 243 (1923)

C. D. Harries, Ber. 24, 3180 (1891)

Decker and V. Fellenberg, Ann. 364, 21 (1909).

A preferred compound according to general formula (I) is:

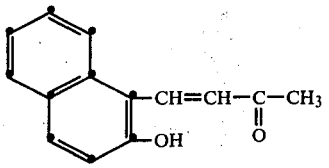

described together with other suitable representatives in the United Kingdom Pat. No. 1,398,265.

A suitable compound according to the general formula (II) has the following structure:

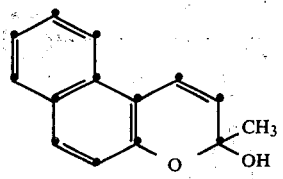

the preparation of which may proceed as follows:

In a 250 ml flask fitted with a reflux condenser and a gas inlet tube reaching nearly the bottom of the flask are introduced:

| | |
|---|---|
| 2-hydroxy-1-naphthaldehyde | 10 g |
| acetone | 50 ml |

The flask is shaken until a solution is obtained and subsequently while the flask is cooled in ice-water dry hydrogen chloride is introduced for 15 min.

Thereupon the reaction mixture is kept at room temperature for 24 hours. The obtained dark green solution is poured into 200 ml of water. A sticky green product separates. The supernatant water layer is removed and the residue treated with 50 ml of methanol by means of which treatment the residue solidifies. The obtained solid is pulverized, washed again with 50 ml of methanol and dried. Yield: 9 g. Melting point: 200° C.

Particularly useful compounds (B) can be found in the following classes (1) and (2).

Class (1) includes organic compounds containing one halogen atom linked to a carbon atom that is directly linked to at least one electron-withdrawing group e.g. $>C=O$, $>SO_2$ or $-C\equiv N$.

Class (2) includes organic perhalo compounds e.g. a perchloroalkane or homocyclic perchloro compound.

Preferred organic compounds of class (1) are listed with their structural formula and melting points in Table II.

TABLE II
| Compound no. | Structural formula | Melting point (°C.) |
|---|---|---|
| 1 | 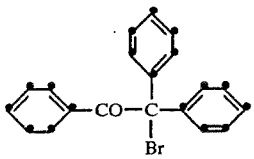 | 97–98 |
| 2 | 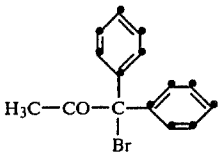 | 55 |
| 3 | 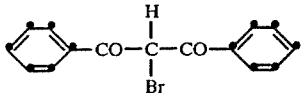 | 93 |
| 4 | 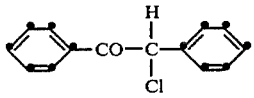 | 64–65 |
| 5 | 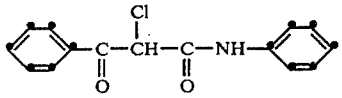 | 126 |
| 6 | 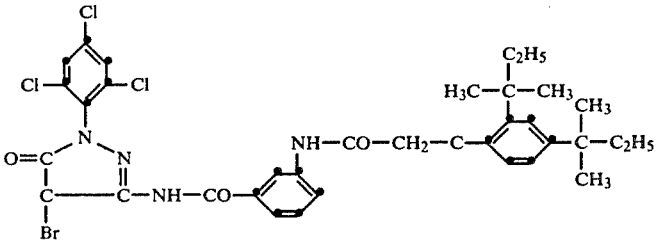 | 130 |
| 7 | 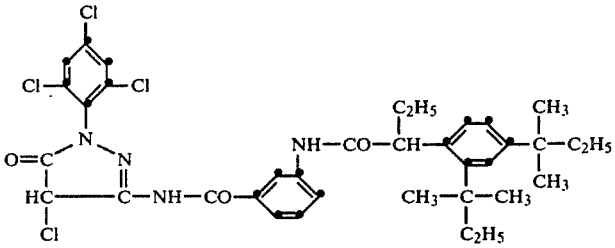 | 144 |
| 8 | 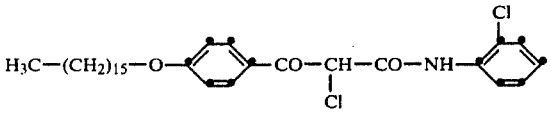 | 73 |
| 9 | 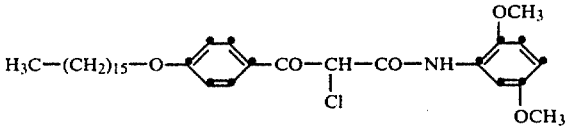 | 76 |
| 10 | 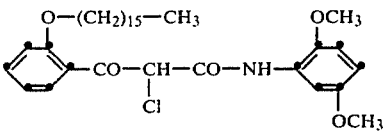 | 62 |
| 11 | 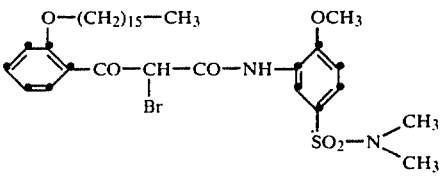 | 67 |

TABLE II-continued

| Compound no. | Structural formula | Melting point (°C.) |
|---|---|---|
| 12 | 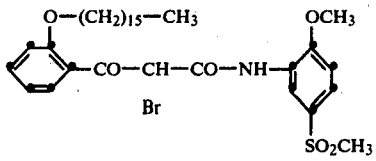 | 105 |
| 13 | 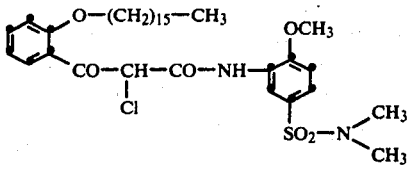 | 67 |
| 14 | 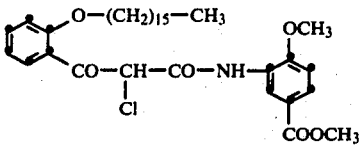 | 85 |
| 15 | 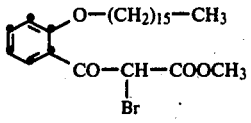 | 46 |
| 16 | 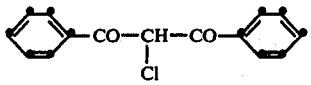 | 88 |
| 17 | 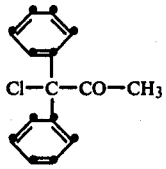 | 50 |
| 18 | 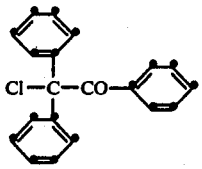 | yellow oil |
| 19 | 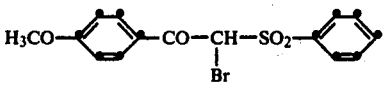 | 134 |

Compound 1 is prepared according to J.A.C.S. 76, 718 (1954), melting point 97–98° C.

Compound 2 is prepared as follows:

52.2 g (0.25 mole) of 1,1-diphenyl acetone are dissolved in 250 ml of carbon tetrachloride in a 1-liter reaction flask provided with a stirrer, a thermometer, and a dropping funnel. 12.8 ml (0.25 mole) of bromine dissolved in 75 ml of carbon tetrachloride are added with stirring in 45 min. The reaction mixture is kept at −15° C. Subsequently, the temperature is allowed to rise to 20° C. and stirring is continued for 2 h. 1 ml more of bromine is added and the stirring is continued for 1 h. The solvent of the reaction mixture is evaporated under reduced pressure. The resulting brown oil is boiled with 250 ml of n-hexane and the solution is filtered. The crystals obtained upon cooling are sucked off and recrystallized from isopropanol. Melting point: 55° C.

Compound 3 is prepared as follows:

112 g of dibenzoyl methane are dissolved in 400 ml of anhydrous chloroform.

The solution obtained is cooled in a mixture of ice and sodium chloride.

25.5 ml of bromine dissolved in 200 ml of anhydrous chloroform are added dropwise in 1 h.

The solvent of the reaction mixture is evaporated under reduced pressure. The residue is recrystallized from a mixture of chloroform and n-hexane (1:2 parts by volume). Melting point: 93° C.

Compound 4 is prepared according to Org.Sny.Coll-.Vol. II (1950) p. 159. Melting point: 64°–65° C.

Compound 5 is prepared as follows:

597.5 g of benzoylacetanilide are mixed whilst heating with 4.5 l of chloroform till dissolution.

3337.5 g sulfonyl dichloride (208.5 ml) are added dropwise within 30 min. and the heating is stopped.

The reaction mixture is stirred at room temperature for 3 h. Subsequently, 50 ml of methanol are added to decompose the excess of sulfonyl dichloride. The reaction mixture is stirred for 10 min. The volatile compounds in the reaction mixture are removed by evaporation and the dry reactied product is recrystallized from ethanol. Melting point 126° C.

Compound 6 is prepared as follows:

In a 500 ml three-necked flask equipped with a stirrer, a dropping funnel, a thermometer, and a calcium chloride drying tube 134.3 g of 1-(2,4,6-trichlorophenyl)-3-[m-(2,4-di-t-pentylphenoxy-acetamido)-benzamido]-2-pyrazolin-5-one dissolved in 200 ml of acetic acid. The solution is cooled to room temperature and bromine is added in 30 min. The temperature rises to 36° C. thereby. After 1 h of stirring the reaction mixture is poured into ice water and the precipitate formed is washed until free from acid. The resulting product is dried at 50° C. Melting point: 130° C.

Compound 7 is prepared as follows:

In a 1 l reaction flask provided with a stirrer and dropping funnel 69 g of 1-(2',4',6'-trichlorophenyl)-3-{3'-[1''-(2''',4'''-di-t-pentylphenoxy)-propyl]-carbonylaminobenzamido}4,4-dichloropyrazolone-5 were dissolved in 630 ml of acetonitrile at room temperature.

16.8 ml of triethylphosphite are added dropwise in 5 min whereby the temperature rises to 30° C. Stirring is continued for 4 h and the reaction mixture is kept overnight. Subsequently, an additional amount of triethyl phosphite is added and such is repeated each hour until 37 ml have been added. As a result thereof all 4,4-dichloro-pyrazolone starting product is converted into compound 7 (a 4-monochloropyrazolone). The acetonitrile is evaporated and 180 ml of methanol are added to the resulting oily residue. The mixture obtained is poured into a mixture of 33.4 ml of a 30% by weight solution of sodium methylate and 90 ml of methanol and kept for 45 min at room temperature. The reaction mixture is acidified with acetic acid to pH 5 and poured into 500 ml of water. The precipitate formed is sucked off and dried at 60° C. Melting point: 144° C.

Compounds 8, 12, and 13 are prepared analogously to the benzoyl acetanilide couplers for silver halide colour photography described in the U.S. Pat. No. 2,728,658.

Compound 9 is prepared as follows:

In a 1 l three-necked reaction flask provided with a dropping funnel and a stirrer 107.8 g of p-n-hexadecyloxybenzoylaceto-2',5'-dimethoxyanilide are introduced in 500 ml of chloroform at room temperature.

16.2 ml of sulphuryl chloride dissolved in 100 ml of anhydrous chloroform are added within 25 min. Stirring is continued for 1 hour. Subsequently, the solvent is evaporated. The oily residue is treated with methanol, which is removed likewise by evaporation. The solid residue melts at 59° C. By recrystallization from acetonitrile followed by recrystallization from isopropylether the melting point is raised to 78° C.

Compound 10 is prepared as follows:

In a 1 l reaction flask equipped with a stirrer, a thermometer, a dropping funnel with drying tube, and an air-condenser, which via a drying tower is connected to a scrubber, 404 g of o-n-hexadecyloxybenzoylaceto-2',5'-dimethoxy-anilide are mixed with 1875 ml of anhydrous chloroform. A solution of 60.8 ml of sulphuryl chloride in 375 ml of chloroform is added within 30 min. The reaction is slightly exothermic, so that the temperature rises to 22° C. Stirring is continued for 1 h. Chloroform is evaporated and the residue is recrystallized from acetonitrile. Melting point: 61° C.

Compound 11 is prepared as follows:

In a 10 l reaction flask equipped with a stirrer, a thermometer, a dropping funnel, and an air condenser, which via a drying tower is connected to a scrubber 1232 g of o-n-hexadecyloxybenzoylacet-2'-methoxy-5'-dimethylaminosulphonylanilide is introduced and dissolved in 1 l of anhydrous chloroform.

A solution of 162 ml of $SO_2Cl_2$ in 1 l of anhydrous chloroform is added within 75 min. Stirring is continued for 2 h. The solvent is removed by evaporation and the residue obtained is recrystallized from isopropyl ether.

Melting point: 67° C.

Compound 14 is prepared as follows:

In a 2 l three-necked reaction flask 269.3 g of o-n-hexadecyloxybenzoylacet-2'-methoxy-5'-methoxycarbonyl-anilide and 1200 ml of anhydrous chloroform are mixed. 38.4 ml of sulphuryl chloride and 240 ml of anhydrous chloroform are added dropwise in 1 hour to the solution obtained. The temperature rises from 19.5° C. to 25° C. Stirring is continued for 1 h whereupon 200 ml of methanol are added. Subsequently, the reaction mixture is freed from volatile substances under vacuum and the oily residue left is recrystallized from acetonitrile. Melting point: 85° C.

Compound 15 is prepared as follows:

In a 3 l reaction flask equipped with a stirrer and a reflux condenser 2000 ml of carbon tetrachloride are introduced and 418 g of o-n-hexadecyloxybenzoylacetic acid methyl ester and 178 g of N-bromosuccinimide are dissolved therein.

2 g of benzoylperoxide are added portionwise with stirring. The reaction mixture is heated to reflux temperature and kept boiling at reflux temperature for 3 h. The succinimide obtained, floating on the reaction liquid, is removed by suction. The filtrate is dried and the solvent evaporated at 60° C. The residue obtained is treated with hexane and kept overnight. The precipitate obtained is sucked off and washed with cooled hexane. Subsequently, the precipitate is dried under vacuum. Melting point: 46° C.

Compound 16 is prepared according to Doklady Akad. USSR 133596-601 (1960), see C.A. 54 24656 1.

Compound 17 is prepared analogously to compound 2.

Compound 18 is prepared by treating $(C_6H_5)_2CH—CO—C_6H_5$ with sulphuryl chloride in anhydrous benzene.

Compound 19 is prepared analogously to $C_6H_5COCHBr—SO_2C_6H_5$ described in Beilstein 7 I 363.

Compounds 5 to 14 are known for use in silver halide colour photography as 2-equivalent couplers for yellow and magenta carrying at the coupling position a halogen atom. Reference is made for example to U.S. Pat. No. 2,728,658, 3,006,759 and 3,522,651 to the published German patent application DT-OS 2 555 224 and to U.K. Pat. Nos. 1,378,675 and 1,379,813.

Particularly suitable compounds falling within the scope of class (2) and behaving as in the defined tests (X) and (Y) are hexachloroethane and hexachlorocyclopentadiene. The preparation of these compounds is known to those skilled in the art.

The recording material of this invention can be made by mixing the dye precursor compound with the UV-sensitive compound and applying the resulting mixture to a suitable support or coating base.

Although the UV-sensitive coating is preferably applied from a solution in the form of a film on a support, it can also be applied as a dispersion having one of the components in dispersed state in a binder solution containing the other component in dissolved form.

The recording layer may be self-supporting. It may have the form of a sheet or ribbon.

In the recording material the UV-sensitive compound(s) (B) is (are) preferably present in a molar ratio of at least 2:1 with respect to the dye precursor compound(s) (A).

The amount of spiropyran compound per sq.m in said layers preferably ranges from 0.2 g to 2 g per sq.m.

A supported recording layer preferably has a thickness of 1 μm to 50 μm in dried state.

Transparent recording materials are produced by applying the dye-forming compounds together with a suitable binder from a clear solution to a transparent support.

Preference is given to transparent supports having an optical density not exceeding 0.10, e.g., glass plates and supports made of organic resins e.g. polyethylene terephthalate or cellulose triacetate.

In reproduction techniques wherein the prints are to be produced on an opaque or semi-transparent background preferably a paper sheet is used as the support for the recording layer.

Suitable binding agents for the recording layers of the present invention are organic film-forming binding agents e.g. polystyrene, poly(meth)acrylates, and polyvinyl chloride homo- and copolymers.

In a preferred recording layer composition of the present invention a polymer containing N-vinylcarbazole units is used to serve as binding agent for the dye precursor compound.

A polymer contaning N-vinylcarbazole units as used in the test material increases the speed. The higher the content of N-vinylcarbazole units in the polymeric binding agent, the higher the photosensitivity. For a survey of suitable N-vinylcarbazole-containing polymers and other sensitizing agents reference is made to the U.K. Pat. No. 1,359,472.

The preparation of the binding agent of the test material is given here for illustrative purposes.

Preparation of copoly(N-vinylcarbazole/methyl acrylate/β-hydroxyethyl acrylate) (60/30/10 by weight)

In a 2-liter reaction flask provided with a stirrer, a condenser, two dropping funnels, and a nitrogen inlet the following substances are introduced and mixed while nitrogen gas is bubbled through:

800 ml of demineralized water, 10 g of HOSTAPON T (trade name of Farbwerke Hoechst A.G. for a wetting agent having the formula:

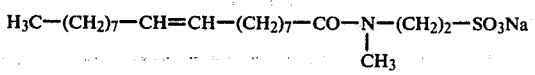

$$H_3C-(CH_2)_7-CH=CH-(CH_2)_7-CO-\underset{\underset{CH_3}{|}}{N}-(CH_2)_2-SO_3Na$$

120 g of N-vinylcarbazole.

The reaction mixture is heated on a waterbath to 75° C. Subsequently, a mixture of 60 g of methyl acrylate and 20 g of β-hydroxyethyl acrylate is added dropwise in 30 min from one dropping funnel and simultaneously 40 ml of a 2.5% by weight aqueous solution of 4,4'-azobis(4-cyanovaleric acid) are added dropwise from the other dropping funnel. The temperature of the reaction mixture rises to 80° C. and some reflux takes place. The reaction mixture is kept 20 min at 80° C. and then raised to 90° C. and kept at that temperature for 3 h. The reaction mixture is then stirred overnight and allowed to cool down to room temperature. The precipitate formed is sucked off and treated with a mixture of 900 ml of tetrahydrofuran, 900 ml of methanol, and 900 ml of a 5% by weight solution of sodium chloride. The soft copolymer precipitate that becomes brittle is separated by decantation and washed thrice with water.

In the recording method of the present invention preferably high-energy lasers having a photon-emission in the 200 nm to 400 nm wavelength range are used.

A particularly useful type of high-energy laser is the ion laser in which stimulated emission takes place between two levels of an ion rather than of a whole neutral atom. Dissipating great quantities of power, ion lasers have peak outputs orders of magnitude above that of atomic lasers, with a capability of delivering several tens of watts of power in the form of electromagnetic radiation in the range of 235 to 1550 nm (see IEEE Spectrum March 1972—p. 26–40, The Family of Lasers—A survey by Marce Eleccion). In connection with the present invention argon ion lasers having in the U.V. spectrum emission lines at 351.1 and 363.8 nm and He-Cd lasers emitting at 325 nm are preferred.

In order to dispose of a favourable writing speed the recording preferably proceeds with an UV-radiation intensity of more than $2\times10^{12}$ erg/sq.cm.s. Such high radiation intensity and a good image resolution are obtained by focussing the laser beam of e.g. an argon ion laser onto an area of but 4 sq.μm.

The intensity and deflection of laser beams can be modulated by means well known to those skilled in the art. Since the generation and control of laser beams of high energy are accomplished by apparatus and methods that do not form a part of the present invention and that are well known to those skilled in the art, no detailed explanation thereof is given herein.

The recording process of the present invention is not limited by the information to be stored. For example sound track and video signals and facsimile signals can be used for laser beam modulation occasionally through the application of one or more transducers.

The following examples illustrate further the present invention.

The percentages are by weight unless otherwise mentioned.

EXAMPLE 1

20 g of hexachloroethane and 10 g of β-methylnaphthospiropyran were dissolved in 1 l of a 5% solution of copoly(N-vinylcarbazole/methyl acrylate/hydroxyethyl acrylate) (60/30/10%) in trichloroethane. A 5% solution in trichloroethane of said terpolymer has a viscosity of 55 cP at 20° C.

2 ml of the solution obtained were poured on a glass plate fixed on a fast-rotating turntable (1000 rev./min). The glass plate had a thickness of 1.7 mm and sized 5 cm×5 cm. The coating was dried. The material had an optical density of 0.38 at 350 nm, which was measured with the SP 1800 UV spectrophotometer of Unicam (trade name). The recording layer was exposed on a turntable to the output of an Argon ion laser (351.1'363.8 nm). An output of 20 mW was focussed on a surface area of 4 sq.μm. The recording was performed by writing a spiral track with the laser beam on the recording layer. The writing started at the periphery of the glass plate moving the beam towards the centre, while the turntable was rotated at an angular speed of 50 rev./min. The recording material on the turntable had an inclination of 0.3° to the optical axis of the exposure system, as a result of which upon turning of the turntable a given track area is always exposed in focus.

Figure 2:
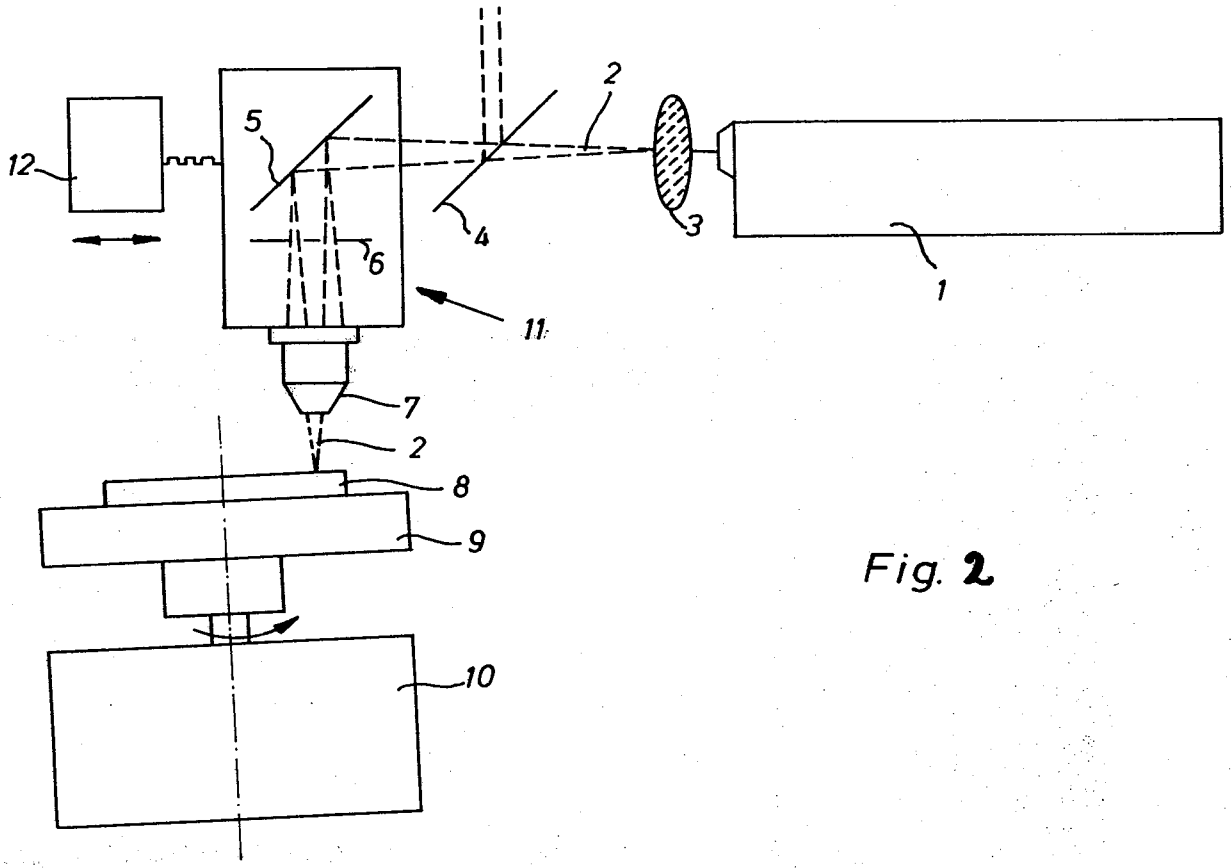

The exposure technique is illustrated by the accompanying FIG. 2 showing a schematic view of the applied apparatus. Herein the laser 1 produces a laser beam 2 that is focussed with a lens 3. Element 4 represents a semi-transparent mirror (beam-splitter), by means of which the focussing can be checked. A mirror 5 deflects the laser beam through a diaphragm 6 into the microscope objective 7. Through said objective 7 the focussed laser beam 2 strikes the recording material 8 that is placed on a turntable 9 driven by an electric motor 10. The axis of the turtable makes a small angle (0.3°) with the optical axis of the beam so that in part of the spiral track the beam will be always in focus. The spiral track is obtained by lateral motion of the optical device 11 containing the mirror 5 by means of a driving means 12.

In the focus area (maximum density area) the emitted laser radiation intensity was $2.5\times10^{12}$ erg/sq.cm.s. The received UV-radiation dose was $4.7\times10^{7}$ erg/sq.cm. This resulted in a very narrow line having a width of 1.5 to 2 μm and a maximum white light specular density of 0.7 above inherent fog measured with the already mentioned Ansco (trade name) automatic recording microdensitometer, Model 4.

The test exposure of the same material as defined in test (X) gave a maximum density increase of but 0.031 at 620 nm, the density measurement being a totally diffuse density measurement.

EXAMPLE 2

20 g of compound (1) of Table II and 10 g of β-methylnaphthospiropyran were dissolved in 1 l of a solution as specified in Example 1 and applied in the same way to a glass plate.

The dry recording material had a density of 0.38 at 350 nm measured with the spectrophotometer of Example 1. The test exposure as defined in test (X) gave a maximum density increase of but 0.091 at 588 nm. The material obtained was exposed to UV-radiation emitted by the Argon ion laser of Example 1, the turntable rotating at a speed of 50 rev./min. A total output of 20 mW was focussed on a surface area of 4 sq.μm. In the focus area (the maximum density area) applied laser radiation intensity was $2.5\times10^{12}$ erg/sq.cm.s. The UV-radiation dose received was $4.7\times10^{7}$ erg/sq.cm.

The maximum white light specular density obtained in the narrow (1.5 to 2 μm) spiral line was 0.6 above inherent fog.

EXAMPLE 3

20 g of compound (2) of Table II, 10 g of β-methylnaphthospiropyran, and 800 ml of a solution as described in example 1 were coated on a glass plate. The dried recording material had a density of 1.2 at 350 nm measured with the spectrophotometer of Example 1. It was exposed by means of the Argon ion laser of Example 1 with an output of 20 mW of ultraviolet radiation (351.1+363.8 nm), the turntable rotating at a speed of 100 rev./min and the beam being focussed on a surface of 4 sq.μm, so that in the focus area the applied laser radiation intensity was $2.5+10^{12}$ erg/sq.cm. The UV-radiation dose received was $2+10^{7}$ erg/sq.cm. This resulted in a spiral line with same density as described in example 1. The test exposure as defined in test (X) gave a maximum density increase at 615 nm of only 0.036.

EXAMPLE 4

Example 1 was repeated with the difference, however, that 20 g of compound (3) of Table II were used instead of 20 g of hexachloroethane.

The dried material had a density of 1.4 at 350 nm measured with the spectrophotometer of Example 1. The writing proceeded at 200 rev./min of the turntable.

The test exposure as defined in test X gave a maximum density increase at 590 nm of only 0.13.

The maximum white light specular density of the obtained spiral line was 0.7 above inherent fog.

EXAMPLES 5–19

In table III the results obtained with other compounds of table II in the composition of Example 4 are mentioned. The laser beam writing procedure is the same as that described in Example 1. The particular angular speed of the turntable used is mentioned in the following table III.

TABLE III

| No. of the compound | Dens. of the dried material at 350 nm | Rev./min of the turntable | Density increase according to test X | Maximum white light specular density above inherent fog in the spiral line |
|---|---|---|---|---|
| 4 | 1.2 | 200 | 0.02 at 630 nm | 0.7 |
| 5 | 1.2 | 200 | 0.086 at 580 nm | 0.4 |
| 6 | 1.2 | 100 | 0.099 at 630 nm | 0.4 |
| 7 | 1.2 | 100 | 0.024 at 610 nm | 0.4 |
| 8 | 1.2 | 200 | 0.030 at 600 nm | 0.3 |
| 9 | 1.2 | 200 | 0.018 at 590 nm | 0.3 |
| 10 | 1.2 | 200 | 0.031 at 590 nm | 0.3 |
| 11 | 1.2 | 200 | 0.039 at 590 nm | 0.3 |
| 12 | 1.2 | 200 | 0.039 at 590 nm | 0.3 |
| 13 | 1.2 | 200 | 0.031 at 600 nm | 0.5 |
| 14 | 1.2 | 200 | 0.018 at 600 nm | 0.5 |
| 15 | 1.2 | 100 | 0.017 at 630 nm | 0.3 |
| 16 | 1.5 | 200 | 0.038 at 560 nm | 0.6 |
| 17 | 1.5 | 100 | 0.015 at 600 nm | 0.3 |
| 18 | 1 | 50 | 0.021 at 560 nm | 0.6 |
| 19 | 1.2 | 50 | 0.15 at 610 nm | 0.5 |

EXAMPLE 20

Example 1 was repeated with the difference, however, that 20 g of hexachlorocyclopentadiene.

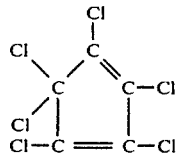

were used instead of 20 g of hexachloroethane.

The dried material had a density of 1.2 at 350 nm measured with the spectrophotometer of Example 1. The writing occurred at 100 rev.min of the turntable.

The test exposure as defined in test X gave a maximum density increase at 560 nm of only 0.094.

The maximum white light specular density of the spiral line obtained was 0.4 above inherent fog.

EXAMPLE 21

Example 1 was repeated with the difference, however, that 10 g of

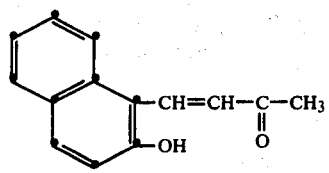

were used as dye precursor instead of 10 g of β-methylnaphthospiropyran.

The dried material had a density of 0.57 at 350 nm measured with the spectrophotometer of Example 1. The writing occurred at 100 rev./min of the turntable.

The test exposure as defined in test X gave a maximum density increase at 625 nm of only 0.022.

The maximum white light specular density of the spiral line obtained was 0.4 above inherent fog.

EXAMPLE 22

Example 21 was repeated with the difference, however, that the 20 g of hexachloroethane were replaced by 20 g of compound 16 of Table II.

The dried material had a density of 0.79 at 350 nm measured with the spectrophotometer of Example 1. The writing occurred at 100 rev./min of the turntable.

The test exposure as defined in test X gave a maximum density increase at 590 nm of only 0.067.

The maximum white light specular density of the spiral line obtained was 0.4 above inherent fog.

We claim:

1. A recording method which is insensitive to daylight exposure while capable of directly forming a visible image by controlled laser beam exposure, which method comprises exposing a recording material information-wise to ultra-violet radiation, in the range of 200 nm to 400 nm, with a radiation intensity of at least $5\times10^{11}$ erg/sq.cm.s so that the recording material receives a radiation energy dose of at least $1\times10^{7}$ erg/sq.cm, the said recording material containing in a layer of an organic binder medium a mixture consisting essentially of:

(A) at least one dye precursor compound, which is a spiropyran compound or a compound corresponding to one of the general formulae

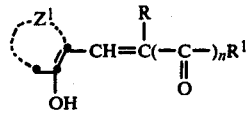

(I)

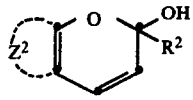

(II)

wherein:

R represents hydrogen, a lower alkyl ($C_1$-$C_3$) group, phenyl or phenyloxy, $R^1$ represents an organic group, $Z^1$ represents the necessary atoms to close a homocyclic ring or ring system including such a ring or ring system in substituted state, $Z^2$ represents the necessary atoms to close a homocyclic ring or ring system, $R^2$ represents a lower alkyl ($C_1$-$C_5$) group, and n is 1 or 2, (B) at least one organic UV-sensitive compound corresponding to one of the following general formulae

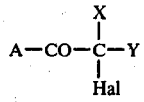

(III)

wherein:

A is phenyl, alkoxyphenyl or methyl,

X is hydrogen or phenyl,

Hal is a chlorine or bromine atom and

Y is alkoxycarbonyl, phenyl, phenylcarbonyl, phenylsulfonyl, or a phenylcarbamoyl group,

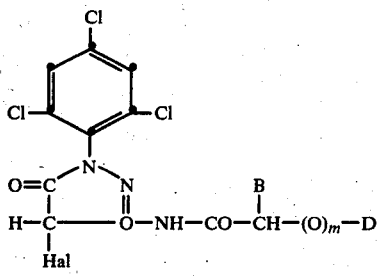

(IV)

wherein:

m is 0 or 1,

Hal is a chlorine or bromine atom,

D is an alkyl-substituted phenyl group, and

B is hydrogen or alkyl containing up to two carbon atoms, said UV-sensitive compound exhibiting when present in a test recording material as defined in the specification and (a) subjected to test exposure (X) as defined in the specification a density increase at the wavelength of maximum absorption in the visible light range of not more than 0.15, the density measurement being a totally diffuse density measurement, and (b) when subjected to test exposure (Y) as defined in the specification a white light specular density of at least 0.35 above inherent fog.

2. A method according to claim 1, wherein the spiropyran compound is a spiropyran containing in ortho and meta position of the oxygen atom of at least one pyran ring a condensed benzene or polycyclic aromatic condensed ring system.

3. A method according to claim 2, wherein said spiropyran compound is one of the compounds of table I of the specification.

4. A method according to claim 1, wherein the recording material compound(s) (B) are present with respect to compound(s) (A) in a molar ratio of at least 2:1.

5. A method according to claim 1, wherein the organic binder medium contains a polymer containing N-vinylcarbazole units.

6. A method according to claim 1, wherein the information-wise exposure is effected with a radiation beam containing ultra-violet radiation produced with an argon-ion laser.

7. A method according to claim 6, wherein said beam is focussed on an area of 4 sq.$\mu$m of the recording material.

8. A method according to claim 1, wherein the information-wise exposure is effected with a He-Cd ion laser emitting in the ultra-violet spectrum.

9. A recording material, which contains in a layer in an organic binder medium a mixture of:

(A) at least one dye precursor compound which is a spyropyran compound or a compound corresponding to one of the general formulae

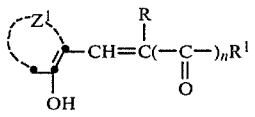

(I)

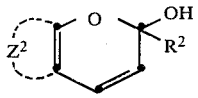

(II)

wherein:

R represents hydrogen, a lower alkyl ($C_1$-$C_3$) group, phenyl or phenyloxy, $R^1$ represents an organic group, $Z^1$ represents the necessary atoms to close a homocyclic ring or ring system, $Z^2$ represents the necessary atoms to close a homocyclic ring or ring system, $R^2$ represents a lower alkyl ($C_1$-$C_5$) group, and n is 1 or 2, (B) at least one organic UV-sensitive compound corresponding to one of the following general formulae

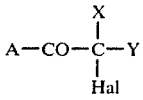

(III)

wherein

A is phenyl, alkoxyphenyl or methyl,

X is hydrogen or phenyl,

Hal is a chlorine or bromine atom and

Y is carboxyalkyl, phenyl, phenylcarbonyl, phenylsulfonyl or a phenylcarbamoyl group,

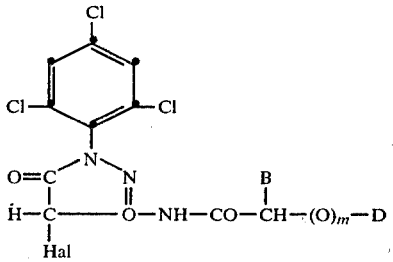

(IV)

wherein:

m is 0 or 1,

Hal is a chlorine or bromine atom,

D is an alkyl-substituted phenyl group, and

B is hydrogen or alkyl containing up to two carbon atoms.

10. A recording material according to claim 9, wherein said layer is present on a glass support or resin support.

11. A recording material according to claim 9, wherein said layer contains said spiropyran in an amount of 0.2 g to 2 g per sq.m.

* * * * *